US011434549B2

(12) United States Patent
Pittari, III et al.

(10) Patent No.: US 11,434,549 B2
(45) Date of Patent: Sep. 6, 2022

(54) CEMENTED CARBIDE CONTAINING TUNGSTEN CARBIDE AND FINEGRAINED IRON ALLOY BINDER

(71) Applicant: U.S. Army Research Laboratory, Adelphi, MD (US)

(72) Inventors: John J. Pittari, III, Nottingham, MD (US); Steven M. Kilczewski, Belcamp, MD (US); Jeffrey J. Swab, Fallston, MD (US); Kristopher A. Darling, Havre De Grace, MD (US); Billy C. Hornbuckle, Aberdeen, MD (US); Heather A. Murdoch, Baltimore, MD (US); Robert J. Dowding, Abingdon, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/807,604

(22) Filed: Nov. 9, 2017

(65) Prior Publication Data

US 2018/0142331 A1 May 24, 2018

Related U.S. Application Data

(60) Provisional application No. 62/420,332, filed on Nov. 10, 2016.

(51) Int. Cl.
*C22C 29/02* (2006.01)
*B22F 3/105* (2006.01)
(Continued)

(52) U.S. Cl.
CPC ..... *C22C 29/02* (2013.01); *B22F 3/105* (2013.01); *B22F 3/14* (2013.01); *C22C 1/051* (2013.01); *C22C 29/067* (2013.01); *C22C 29/08* (2013.01)

(58) Field of Classification Search
None
See application file for complete search history.

(56) References Cited

U.S. PATENT DOCUMENTS 3,723,109 A * 3/1973 Lacock ..... B21C 35/04 419/48
4,075,010 A * 2/1978 Fischer ..... C22C 32/0026 75/235

(Continued)

FOREIGN PATENT DOCUMENTS

WO WO 2005038065 * 4/2005
WO WO2005038065 4/2005

OTHER PUBLICATIONS

English Abstract of Yu et al. (CN 103014472) (Year: 2013).*

(Continued)

*Primary Examiner* — Ronak C Patel
(74) *Attorney, Agent, or Firm* — Christos S. Kyriakou

(57) ABSTRACT

A sintered cemented carbide body including tungsten carbide, and a substantially cobalt-free binder including an iron-based alloy sintered with the tungsten carbide. The iron-based alloy is approximately 2-25% of the overall weight percentage of the sintered tungsten carbide and iron-based alloy. The tungsten carbide may be approximately 90 wt % and the iron-based alloy may be approximately 10 wt % of the overall weight percentage of the sintered tungsten carbide and iron-based alloy. The tungsten carbide may comprise a substantially same size before and after undergoing sintering. The iron-based alloy may be sintered with the tungsten carbide using a uniaxial hot (Continued)

pressing process, a spark plasma sintering process, or a pressureless sintering process. The sintered tungsten carbide and iron-based alloy has a hardness value of at least 15 GPa and a fracture toughness value of at least 11 MPa√m.

17 Claims, 7 Drawing Sheets

(51) Int. Cl.

| | |
|---|---|
| ***C22C 29/08*** | (2006.01) |
| ***B22F 3/14*** | (2006.01) |
| ***C22C 29/06*** | (2006.01) |
| ***C22C 1/05*** | (2006.01) |

(56) References Cited

U.S. PATENT DOCUMENTS

| | | | | |
|---|---|---|---|---|
| 4,531,595 | A * | 7/1985 | Housman | E21B 10/52 175/430 |
| 6,299,658 | B1 | 10/2001 | Moriguchi et al. | |
| 6,340,377 | B1 * | 1/2002 | Kawata | C22C 33/0257 75/231 |
| 6,355,361 | B1 * | 3/2002 | Ueno | G08B 13/2408 324/200 |
| 7,595,106 | B2 | 9/2009 | Ahlen et al. | |
| 7,926,597 | B2 | 4/2011 | Majagi et al. | |
| 8,394,169 | B2 | 3/2013 | Heinrich et al. | |
| 2006/0093508 | A1 | 5/2006 | Ahlen et al. | |
| 2006/0153728 | A1 * | 7/2006 | Schoenung | B22F 9/04 419/32 |
| 2006/0169102 | A1 * | 8/2006 | Heinrich | C22C 29/08 75/238 |
| 2008/0075543 | A1 | 3/2008 | Zhu et al. | |
| 2008/0289880 | A1 | 11/2008 | Majagi et al. | |
| 2010/0290849 | A1 * | 11/2010 | Mirchandani | B22F 7/062 408/144 |
| 2011/0030440 | A1 | 2/2011 | Keane | |
| 2014/0086782 | A1 * | 3/2014 | Gries | C22C 29/00 419/12 |
| 2014/0238556 | A1 * | 8/2014 | Branagan | C21D 8/005 148/547 |
| 2016/0375493 | A1 | 12/2016 | Stoyanov | |
| 2018/0142331 | A1 | 5/2018 | Pittari et al. | |
| 2019/0003019 | A1 | 1/2019 | Ibe | |
| 2019/0071930 | A1 | 3/2019 | Nird | |
| 2019/0321917 | A1 | 10/2019 | Ku et al. | |
| 2020/0024702 | A1 | 1/2020 | Pittari, III et al. | |

OTHER PUBLICATIONS

Chanthapan, et al., Sintering of tungsten powder with and without tungsten carbide additive by field assisted sintering technology, Int. Journal of Refractory Metals and Hard Materials 2012; 31: 114-120 (Year: 2012).

I. Gibson, D.W. Rosoen, and B. Stucker, Additive Manufacturing Technologies, DOI 10.1007/978-1-4419-1120-9_ 1, Springer Science+ Business Media LLC, pp. 133-134 (2010) (Year: 2010).

Pittari et al., Sintering of tungsten carbide cermets with an iron-based ternary alloy binder: Processing and thermodynamic considerations, International Journal of Refractory Metals & Hard Materials 76 (2018) 1-11. (Year: □ 2018).

Chanthapan et al., Sintering of tungsten powder with and without additional tungsten carbide additive by field assisted sintering technology, Int. Journal of Refractory Metals and Hard Materials 2012; 114-120.

Gries et al., Cobalt Free Binder Alloys For Hard Metals: Consolidation Of Ready-To-Press Powder and Sintered Properties, Proceedings of the 2008 International Conference on Tungsten, refractory & Hardmaterials VII, pp. 3-56 to 3-64 (2008) (Year: 2008).

* cited by examiner

CEMENTED CARBIDE CONTAINING TUNGSTEN CARBIDE AND FINEGRAINED IRON ALLOY BINDER

CROSS REFERENCE TO RELATED APPLICATION

This application claims the benefit of U.S. Provisional Patent Application No. 62/420,332 filed on Nov. 10, 2016, the contents of which, in its entirety, is herein incorporated by reference.

GOVERNMENT INTEREST

The embodiments herein may be manufactured, used, and/or licensed by or for the United States Government without the payment of royalties thereon.

BACKGROUND

Technical Field

The embodiments herein generally relate to compositions of matter, and more particularly to compositions of cemented carbide materials with iron alloys.

Description of the Related Art

Tungsten carbide (WC) materials have become critically important in many military and commercial engineering applications, due to their unique combination of high strength, hardness, and fracture toughness. The most common cemented carbides in use today achieve these exceptional properties through the combination of hard tungsten carbide particles within a ductile cobalt (Co) matrix. Cobalt is a costly strategic material and is also an environmentally hazardous material that has been classified as a possible human carcinogen and toxic to aquatic life.

SUMMARY

In view of the foregoing, an embodiment herein provides a sintered cemented carbide body comprising tungsten carbide; and a substantially cobalt-free binder comprising an iron-based alloy sintered with, and uniformly distributed around, the tungsten carbide, wherein the sintered tungsten carbide and iron-based alloy comprises a hardness value of at least 15 GPa and a fracture toughness value of at least 11 MPa√m. In the context of the embodiments herein, substantially cobalt-free refers to the carbide body containing no more than 0.2 mass % Co. The iron-based alloy may be approximately 2-25% of the overall weight percentage of the sintered tungsten carbide and iron-based alloy. The tungsten carbide may comprise approximately 90 wt % and the iron-based alloy may comprise approximately 10 wt % of the overall weight percentage of the sintered tungsten carbide and iron-based alloy. The tungsten carbide may comprise a substantially same size before and after undergoing sintering. The iron-based alloy may be sintered with the tungsten carbide using a uniaxial hot pressing (HP) process. The iron-based alloy may be sintered with the tungsten carbide using a field assisted sintering technology (FAST) process. The iron-based alloy may be sintered with the tungsten carbide using a pressureless sintering (PS) process. The tungsten carbide may comprise a microparticle size of approximately 0.5-20 μm. The iron-based alloy may comprise a solid solution phase without a graphite or $M_6C$ phase.

The iron-based alloy binder may comprise zirconium. The substantially cobalt-free binder may comprise a particle diameter of less than 100 nm.

Another embodiment provides a method of forming a cemented tungsten carbide body, the method comprising providing tungsten carbide; and sintering a substantially cobalt-free binder comprising an iron-based alloy binder with the tungsten carbide to form the cemented tungsten carbide body, wherein the sintered tungsten carbide and iron-based alloy comprises a hardness value of at least 15 GPa and a fracture toughness of at least 11 MPa√m. The sintering may comprise a uniaxial hot pressing (HP) process. The sintering may comprise a field assisted sintering technology (FAST) process. The sintering may comprise a pressureless sintering (PS) process. The iron-based alloy may be approximately 2-25% of the overall weight percentage of the sintered tungsten carbide and iron-based alloy. The tungsten carbide may comprise approximately 90 wt % and the iron-based alloy may comprise approximately 10 wt % of the overall weight percentage of the sintered tungsten carbide and iron-based alloy. The tungsten carbide may comprise a substantially same size before and after undergoing sintering. The tungsten carbide may comprise an average microparticle size of approximately 0.5-20 μm. The substantially cobalt-free binder may comprise a particle diameter of less than 100 nm. The iron-based alloy binder may comprise zirconium.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION

Figure 1B:
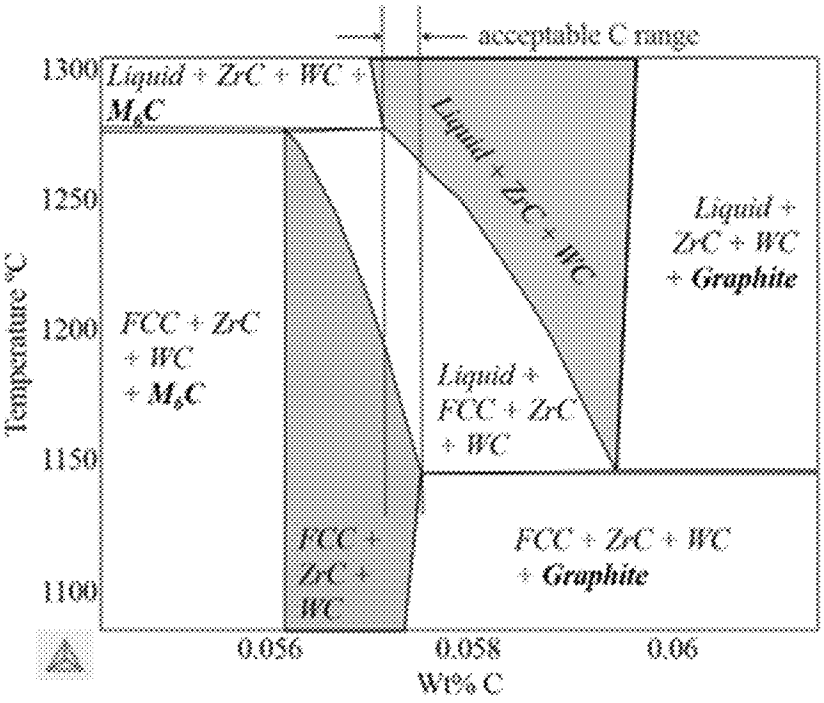
FIG. 1B is a pseudo-binary phase diagram of the W—C—Fe—Ni—Zr system showing the desired carbon range for processing wherein deleterious phases ($M_6C$, graphite) are avoided.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The embodiments herein provide a new cemented carbide material containing tungsten carbide particles with a fine-grained iron-based alloy as the binder. Referring now to the drawings, and more particularly to FIGS. 1A through 7, there are shown exemplary embodiments.

The embodiments herein replace the strategic, yet hazardous and costly material, cobalt, which is commonly added to tungsten carbide to form a cemented carbide material with a fine-grained iron-based alloy material, and without degradation in the material properties or performance of the material, for example, in military applications such as with armor-piercing penetrators. The fabrication techniques provided by the embodiments herein allow one to achieve a cemented carbide containing tungsten carbide particles with an iron alloy binder matrix between the tungsten carbide particles that has a fine-grained crystalline microstructure. The refined microstructure of the iron alloy imparts a higher degree of toughness to the cemented carbide by promoting more uniform deformation, compared with a cobalt binder phase conventionally used in cemented carbide core material.

The composition of matter of the fine-grained iron alloy binder may contain any number of transition metal elements in any proportion, including, but not limited to, nickel, zirconium, molybdenum, tantalum, titanium, and in a variety of combinations depending on the properties and performance required of the densified cemented carbide. The amount of iron alloy binder in the cemented carbide can range from approximately 2% to 25% depending on the properties and performance desired. Additionally, the cemented carbide may contain other additives to promote densification or control grain growth.

The embodiments herein provide a technique to produce non-hazardous tungsten carbide bodies by supplanting the cobalt binder phase with an iron-based alternative. The binder alloy is tuned for a fundamentally new approach, wherein carbides are introduced through precipitation from the liquid binder alloy interacting with the carbon in the tungsten carbide-binder system. The alloying elements chosen for the iron-based binder are expected to form a specific carbide phase, as a thermodynamically stable state, which is a known WC grain refiner. This ability to incorporate carbides through phase formation, rather than as a separate additive, provides a unique method for carbide distribution that takes advantage of more economically feasible and traditional ball-milling processes.

Due to the extremely high melting point of tungsten carbide (≈2785° C.), fully dense tungsten carbide bodies are extremely difficult to produce without the inclusion of an additive that will melt at far lower temperatures in order to cement the WC particles together to form a dense body. This process is known as sintering or, more specifically, liquid phase sintering (LPS).

To demonstrate the feasibility of producing dense, cemented tungsten carbide bodies utilizing the chosen iron-based binder, three different manufacturing processes are described below: uniaxial hot pressing (HP), field assisted sintering technology (FAST), and pressureless sintering (PS). Each technique provides features to facilitate densification of the powder compacts. Other manufacturing processes such as hot isostatic pressing (HIP) and flash sintering, for example, may be utilized in accordance with the embodiments herein. However, for the purposes of describing experimental procedures, the HP, FAST, and PS processes are described below. Furthermore, specific equipment and test parameters are described below for the purposes of describing the experimental procedures that were used. However, the embodiments herein are not limited to these specific equipment and parameters and other comparable equipment and different test parameters may be utilized in accordance with the embodiment herein.

In a hot pressing process, the sintering may be induced by three parameters: pressure, time, and temperature. Adding pressure and temperature to the powder system reduces the sintering time and temperatures required to produce sufficiently densified bodies. Field assisted sintering technology allows for the application of pulsed DC current (in addition to pressure, temperature, and time) directly through a graphite die and, in the case of conductive samples, the powder compact. This current produces highly localized internal heat (Joule heating), in contrast to the external nature of heat generation by heating elements in hot pressing, which facilitates the densification of the powder compact. In variant of FAST processing, external heating elements are used to assist in eliminating thermal gradients. This is often called a "hybrid system". Pressureless sintering does not require a graphite punch and die like HP and SPS do; rather, the sample is formed into a green compact and then placed into a furnace on a near-frictionless (or low friction) bed (to allow for shrinkage). Since there is no external pressure, as in the case of HP and SPS, higher processing temperatures may be selected to facilitate and enhance densification.

Sintering processes are conducted across different compositions, hold times, applied pressures and temperature ranges to demonstrate the efficacy of the embodiments herein. Based upon preliminary experimentation, these four parameters are identified to have the greatest influence on the microstructure and properties of the final body. Individual summaries of the results from each manufacturing technique are provided below.

The tungsten carbide powders used were obtained from Global Tungsten & Powders Corp. (GTP) located in Towanda, Pa. Two different GTP tungsten carbide powders used for the experiment were: SC40S and SC04U. Other tungsten carbide powders may also be used in accordance with the embodiments herein. These materials possess particle sizes differing by a single order of magnitude and are considered, for these purposes to be "coarse" (mean particle size of approximately 4 μm) and "fine" (mean particle size of approximately 0.6 μm), respectively.

The binder alloy utilized was a nanostructured, iron-based alloy developed and processed in-house through mechanical alloying. The iron-nickel-zirconium (Fe—Ni—Zr) alloy was formulated to be an oxide-dispersed strengthened (ODS) steel alloy, where each constituent played a vital role in obtaining the final product. In the W—C—Fe—Ni—Zr system, zirconium's affinity for carbon is exploited to form zirconium carbide (ZrC), which was predicted by thermodynamic modeling calculations. The iron-zirconium carbide interface exhibits very low lattice mismatch, and increases the critical stress required for crack propagation. Additionally, Fe—ZrC composites have promising abrasive wear resistance. Furthermore, zirconium substantially lowers the melting point of the binder system, improving liquid phase formation during sintering. Binder powders from two different milling techniques were produced; one from room temperature milling and another from a cryomilling technique. Cryogenic milling helps the particles maintain their small grain structure by diminishing the effects of recovery and recrystallization. It also reduces agglomerate formation typically seen in room temperature milling of soft materials.

The Fe-8Ni-4Zr and Fe-8Ni-1Zr (at. %) alloys were synthesized by high energy mechanical alloying in a SPEX 8000D shaker mill. The appropriate amounts of Fe, Ni, and Zr starting powders (available from Alfa Aesar, Ward Hill, Mass.), which were −325 mesh and 99.9%, 99.8%, and 99.5% pure, respectively, with a total weight of 10 g were loaded into hardened steel vials (SPEX model 8007) along with milling media (440° C. stainless steel balls) at a ball-to-powder ratio of 10-to-1 by weight, and then sealed inside a glove box containing argon atmosphere (oxygen and moisture are less than 1 ppm). Room temperature ball milling was carried out at 950 revolutions per minute for a total of 20 hours. No processing agents such as sodium chloride, stearic acid, or other organics were utilized. After milling, the vials were again placed inside the glove box and the powders removed and stored until enough consecutive milling runs were completed, thereby generating enough powder (approximately 250 g) for the consolidation experiments. In general, the powders were deagglomerated having individual particle sizes between 10 μm and 100 μm. X-ray diffraction studies revealed the as-milled powder to have a microstructure consisting of a Fe—Ni—Zr supersaturated body centered cubic (BCC) solid solution having an average matrix grain size of ~10 nm. Table 1 shows the bulk hardness of the powders before combination and processing with WC.

TABLE 1

Density and hardness comparison of the nano-iron-based alloy to cobalt

| Binder | Density (g/cc) | Hardness (GPa) |
|---|---|---|
| Nano-iron-alloy | 7.9 | ≈10 |
| Cobalt | 8.9 | ≈1 |

In general, the powders were mixed as a 90 wt % tungsten carbide to 10 wt % iron-alloy composition, unless otherwise noted. This ratio was selected as the baseline because it directly compares to the composition of tungsten carbide-cobalt materials used in armor-piercing cores, which are used for property comparisons.

To guide and optimize the processing and composition of the binder material provided by the embodiments herein, thermodynamic modeling studies were conducted using Thermo-Calc 4.0 software and a custom combination of the TCFE7, TCAL3, and TCMG3 databases to investigate the expected phase compositions of the binder and the anticipated binder and tungsten carbide phase interactions during sintering. FIG. 1A illustrates the ternary phase diagram for the Fe—Ni—Zr binder system at several possible processing temperatures. The desired FCC and liquid phase regions are shaded as indicated. As the processing temperature increases, the region of single phase liquid (or complete melting) both increases in compositional space and encompasses lower alloying (Ni, Zr) additions. Processing temperatures and binder alloy composition were chosen in order to enhance the liquid phase sintering effect and avoid unwanted intermetallic phases.

Figure 1A:
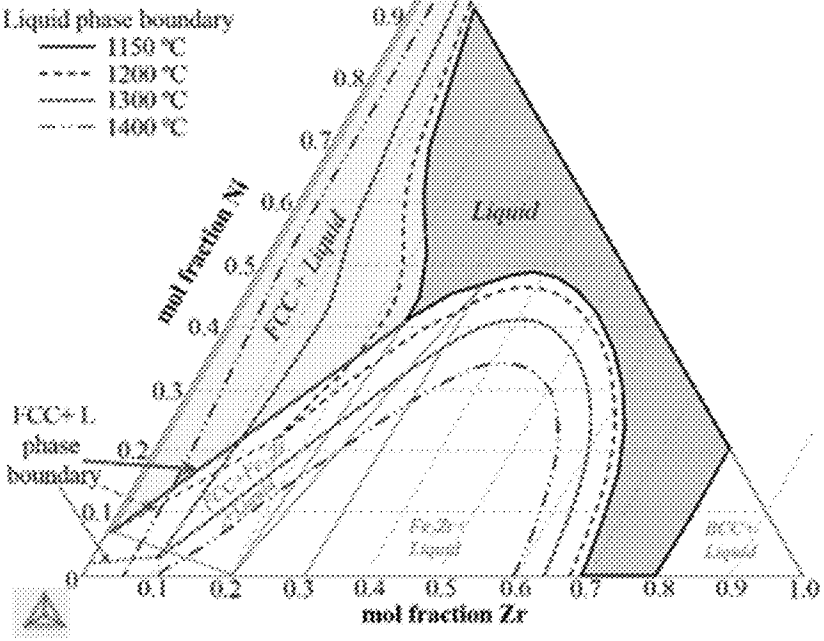
FIG. 1A is a ternary phase diagram for a Fe—Ni—Zr system used as a binder material for cemented WC.
Figure 2B:
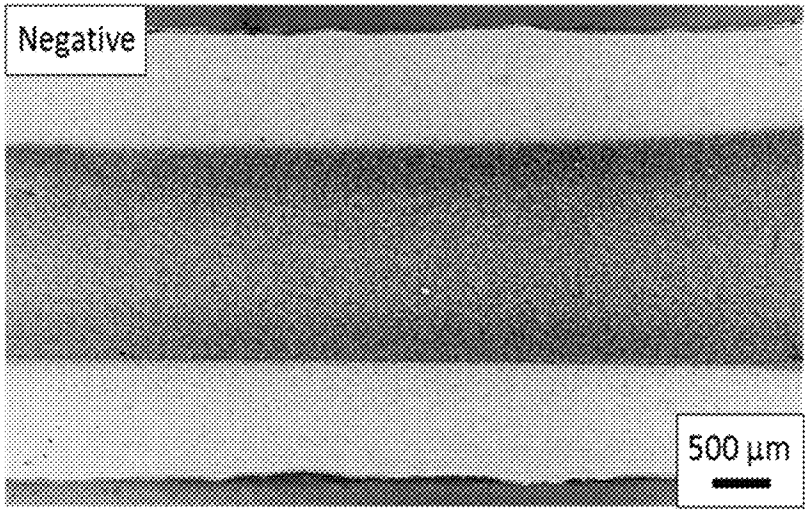
FIG. 2B is a negative of the SEM image of FIG. 2A.
Figure 2A:
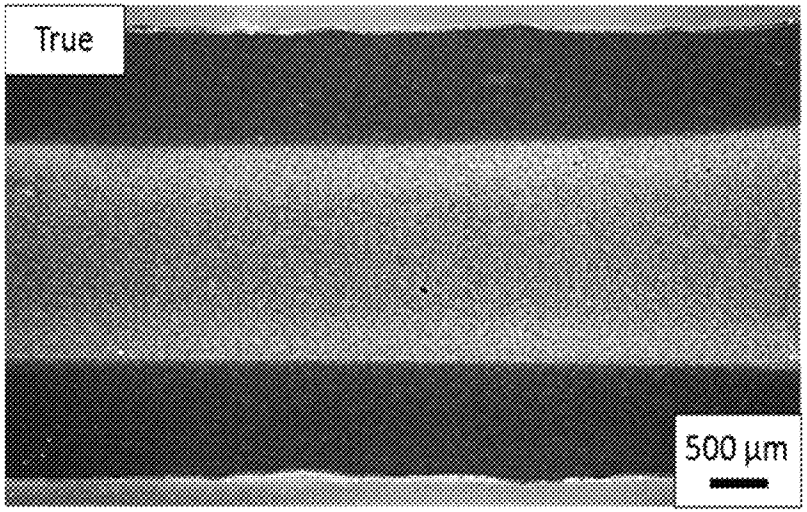
FIG. 2A is a scanning electron microscope (SEM) image of the cross-section of sample HP-12 displaying the graded mesostructure observed in all HP specimens.
Figure 3:
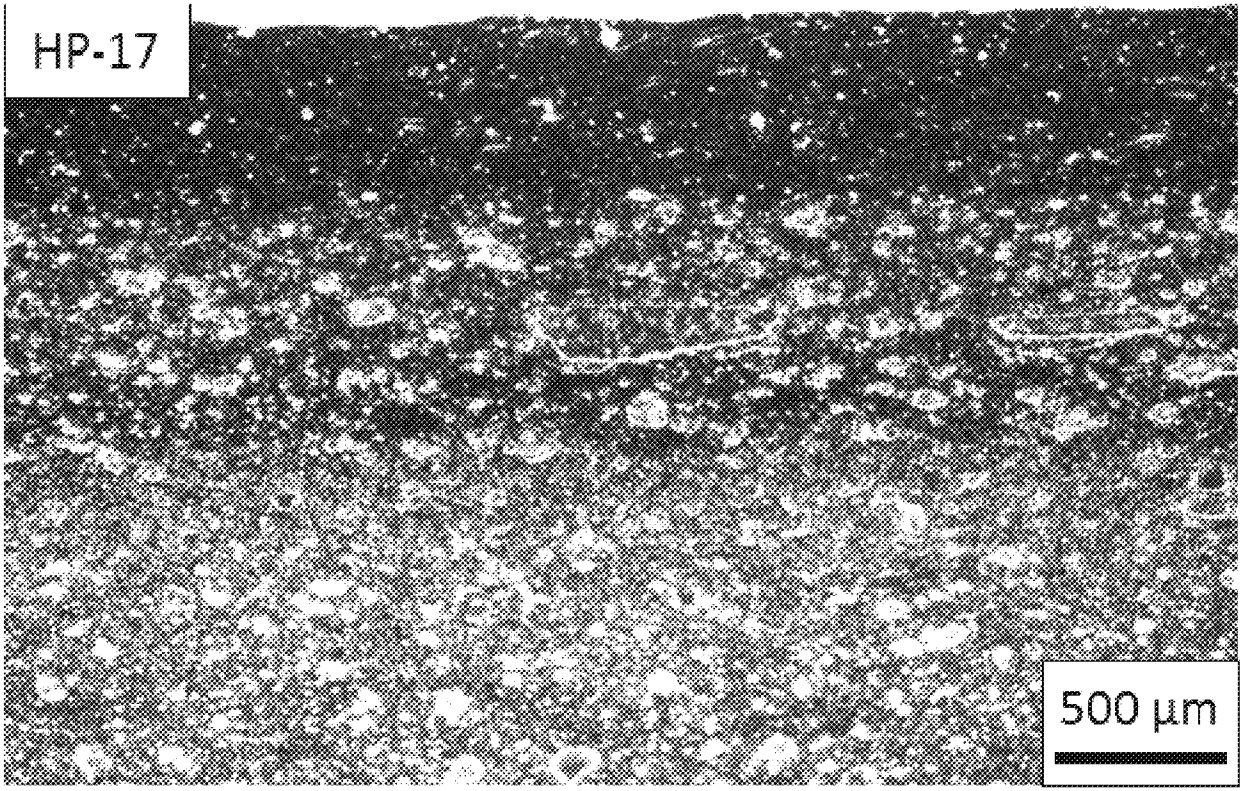
FIG. 3 is a SEM image of the cross-section of specimen HP-17 showing the large binder pools that tended to form in the core region of the produced puck.

The modeling studies also indicated the acceptable carbon ranges necessary to avoid the formation of graphite and other deleterious carbide phases (e.g. $W_3Fe_3C$, referred to as $M_6C$), as shown in FIG. 1B. This system has a slightly narrower acceptable carbon range than the traditional WC-Co system; however, with the modeling results the desired phase region can be correctly targeted. The carbide, ZrC, is also expected to be present in the complete system—this carbide is used as a grain refiner and provides second phase strengthening of the binder phase, and does not need to be avoided.

Differential scanning calorimetry (DSC) and thermogravimetric analysis (TGA) was utilized in tandem to investigate the phase transitions within the powder mixtures. These analysis techniques help provide a fuller understanding of the phase transformations and interactions of the tungsten carbide powder and iron-alloy binder throughout the temperature range required for the sintering procedures. Information acquired from these techniques was used in conjunction with developed ternary phase diagrams to guide the sintering processes.

Uniaxial Hot-Pressing (HP)

The raw tungsten carbide and iron-alloy powders are mixed in glass jars for 5 to 10 minutes at approximately 50-60 G's using a Resodyn LabRAM™ ResonantAcoustic® mixer to homogenize the powder mixture. Experimentally, thirty grams of the mixture is then removed and placed in a graphite die with one-inch diameter graphite punches. Two sheets of GraFoil® material (each sheet is 0.5 mm in thickness) are placed above and below the powder mixture (i.e., between the powder and punches) to aid in the release of the part after hot pressing. A force of approximately 200 lbf was placed on the punches using a hydraulic Carver® press. The punch and die set is then placed in an OXY-GON® Bench Top Hot Press Furnace. Hot pressing studies were conducted between 1000° C. and 1150° C. hold temperatures and hold times ranging from 30 minutes to 3 hours. The load on the punches is maintained at approximately 2000 lbf gauge throughout the duration of the run. All runs are performed in a vacuum environment.

In total, 18 samples were produced using the HP method. The first eight runs explored the hold temperature—and time-space and its resulting effect on the microstructure. The next ten runs explored the effect of composition and WC grain size on microstructure morphology. Coarse (4 μm) and fine (0.6 μm) tungsten carbide powders are mixed with iron-alloy binder powder to produce respective 5 wt % and 15 wt % Fe-binder mixtures (in addition to the standard 10 wt % mixture) using the same procedure as before to determine the effect of composition on the densification, microstructure, and properties of the produced bodies. Two additional runs were made at the 10 wt % iron-binder composition for both coarse and fine WC powder using a cryo-milled version of the iron-based binder to describe the effect on microstructural morphology. The example parameters utilizing the HP process include a 90:10 ratio of the WC:Fe alloy (wt %), between approximately 1000-2000 lbf for the load on die, between approximately 850-1150° C. as the first hold temperature, between approximately 10-180 minutes for the first hold time, approximately 1115° C. as the second hold temperature, and between approximately 60-90 minutes for the second hold time.

Field Assisted Sintering Technology (FAST)

Field assisted sintering technology (FAST) may be turned to as an alternative method to produce dense tungsten carbide bodies with the selected iron-based alloy. All specimens for FAST were produced using the 10 wt % binder composition.

Raw powders are consolidated following the same procedure used during hot pressing. Samples are produced using a graphite punch and die set, just as in the HP procedure. Three separate FAST runs with different ramp stages and maximum amperages are made. The parameters for each are provided in Table 2. Generally, FAST furnaces are current-controlled rather than temperature-controlled (as in HP), thus the maximum temperature reached during each run is also presented. This temperature is measured using a pyrometer focused on the outer surface of the die.

TABLE 2

Field assisted sintering technology parameters for each sample

| Sample | Stage 1 | Stage 2 | Stage 3 | Max. Temp. (° C.) |
|---|---|---|---|---|
| FAST-1 | 200 A/min to 2000 A | N/A | −200 A/min to 0 A | 1275 |
| FAST-2 | 200 A/min to 1475 A | 150 A/min to 1850 A | −200 A/min to 0 A | 1280 |
| FAST-3 | 100 A/min to 1475 A | 150 A/min to 1800 A | −200 A/min to 0 A | 1247 |

Note:
The pressure on the punches for all SPS tests is 100 lbf

Pressureless Sintering (PS)

Powder mixtures were produced using the same procedure as for the HP and FAST methods with the exception of the substitution of a ball milling procedure for the acoustic mixing. A ball milling procedure is executed on a mixture of 90 wt % WC and 10 wt % Fe-binder. This process "smears" the softer binder grains onto the harder WC grains, producing a "coating" of binder on each WC particle that creates a better dispersion of the binder amongst the powder compact.

No external pressure is applied during sintering for this technique, the green body density is increased to aid the densification of the processed specimens. In order to achieve this, the powder compact is first pressed in a hydraulic press, at a much higher force than used for the HP or FAST samples. In one version of the process some parts are removed from the die and placed in a vacuum-sealed package to undergo a 60 ksi cold isostatic pressing (CIP) procedure. The compacted green bodies are placed in an alumina crucible on smooth alumina balls, which may be used to create a near-frictionless surface to accommodate shrinkage during densification. An alumina lid is placed on a crucible, and the whole assembly is placed on a porous alumina setter inside of an alumina tube contained within the furnace. The ends of the alumina tube are capped off with gas inlet and outlet ports. Argon gas (of initial 99.999% purity, referred to as ultra-high purity) flows through a gettering furnace (increasing the purity to <1 ppm $O_2$) and then into the process tube. These conditions are maintained throughout the duration of the sintering procedure.

The sintering temperatures for PS range from 1175° C. to 1475° C. This higher temperature range is due to the fact that there is no applied pressure to the part and additional thermal input is needed to bring the sintering process to full densification. This requires processing in a different region of process space with lower pressure. Hold times range between two and 20 hours to control the microstructural development.

Characterization Techniques

The quality of all specimens was initially judged based on their density in relation to the theoretical density (TD) for that composition. Further, three benchmark property requirements were selected for replacing WC-Co cermets: 2 kg Knoop hardness of 15 GPa, fracture toughness of 11 MPa($m^{1/2}$), and flexure strength of 3 GPa. These baseline values are selected to be equal to, or exceeding, current properties as observed in WC-10% Co AP cores. Fabricated specimens had dimensions sufficient for Knoop hardness and Palmqvist fracture toughness measurements via indentation methods, while flexure strength could not be obtained from these specimens.

Density Measurements

The density of the fabricated parts was measured by two different procedures for comparison accuracy. An initial measurement was made using Archimedes' method. The liquid used for sample immersion was deionized water. Measurements made using the Archimedes' method were verified using helium pycnometry.

Uniaxial Hot-Pressing

Hot pressing is demonstrated to produce sufficiently dense, cemented tungsten carbide bodies using the iron-based binder alloy. The first eight runs (HP-1 through HP-8) revealed that density increased with hold temperature and pressure, and porosity decreased. However, a substantial change in density is not be found above a 1115° C. hold temperature, hence this value was selected as the optimal processing temperature for the two-stage consolidation. It was further found that above 1115° C. there is "squeeze-out" of liquid material along the die-punch wall that is a result of binder flow. The squeeze-out is further evidence that conditions suitable for complete melting of the binder have been reached.

The percent of the theoretical density for the various compositions range from 88.0% to 97.8%, and generally increase with hold temperature and die load, as noted previously. While the bodies produced from optimal hot pressing parameters have high percentages of theoretical densities, they all generally possess one common artifact—a graded mesostructure. An example of this feature is presented in FIGS. 2A and 2B.

The relative thickness and amount of each band varies in each sample; and it is a persistent artifact present in all HP samples. Further experiments where the graphite die and punches were coated with boron nitride spray as an insulating barrier against this reaction did not eradicate the result. This graded mesostructure leads to variable properties across the regions within the body. In general, there are two identifiable "layers" within the mesostructure, however, sometimes more inter-layers are apparent that exhibit mixed properties of the rim and core areas. The rim regions are extremely porous. Core areas typically have large pools of binder, sometimes up to the millimeter scale, similar to those shown in FIG. 3.

The percent of the theoretical density observed tends to increase with decreasing binder phase volume. It was observed that samples produced using cryomilled binder also have significantly lower percentages of theoretical density than their corresponding samples made from room temperature milled binder powder. Binder pooling also tends to increase in the samples containing cryomilled binder.

The graded mesostructure leads to gradients in hardness values based upon the location of the indent. Hardness values at the rim region are approximately 16 GPa, while the core regions are softer, exhibiting a hardness of only 13 GPa. The core is softer due to the binder pooling issue. The binder phase is much softer than the tungsten carbide phase seen in the majority of the rim region. These results are still better than the conventional WC—Co material (12.9 GPa), indicating that the Fe-alloy binder provided by the embodiments herein are an improvement over the traditional cobalt binder.

Field Assisted Sintering Technology

Figure 4B:
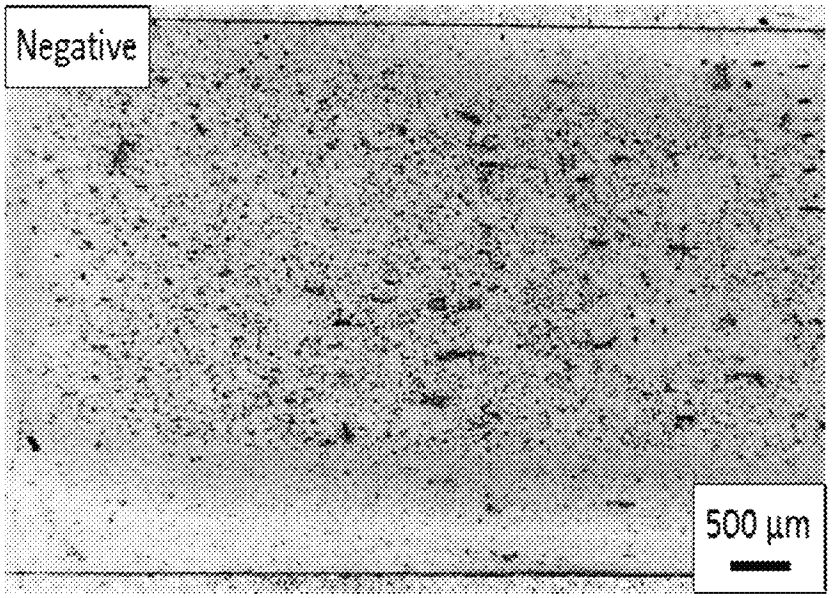
FIG. 4B is a negative of the SEM image of FIG. 4A.
Figure 4A:
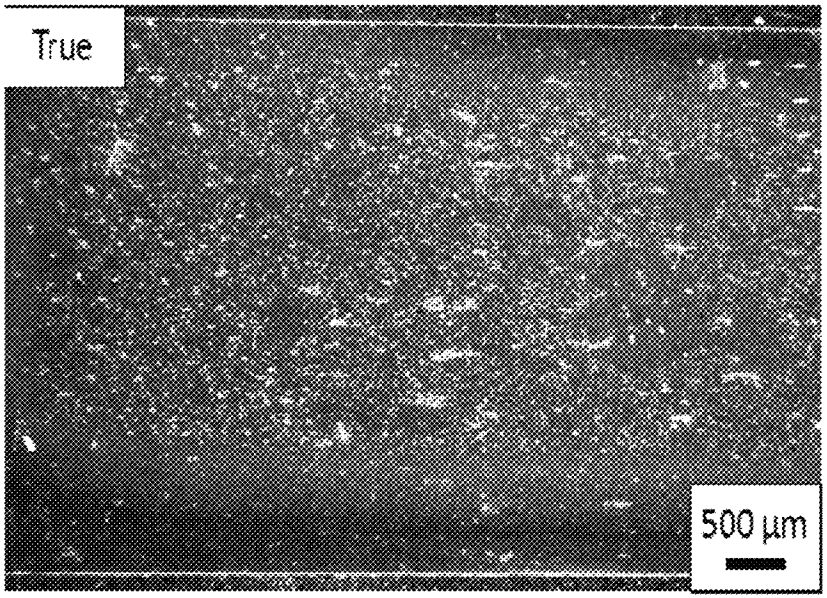
FIG. 4A is a SEM image of the cross-section of sample SPS-2 revealing the presence of a graded mesostructure due to processing.

The percent of theoretical densities range between 90.8% and 94.9% for specimens produced using field assisted sintering technology. The specimens exhibit similar mesostructures to the samples made by the HP process; the same graded mesostructure is present, as shown in FIGS. 4A and 4B. While the number of gradations and their respective thicknesses may vary it is observed that there are graded mesostructures present in all FAST samples.

The FAST samples possess similar hardness profiles and characteristics when compared to the HP samples. The core region is softer, with hardness values around 13.5 GPa, and the rim region is harder, around 16 GPa. Mean hardness values are presented in Table 3, along with the percentage of theoretical density measurements and the maximum temperature reached during the FAST process.

TABLE 3

Density and hardness results for each of the FAST samples

| Sample | % TD | Hardness, $HK_2$ (GPa) | Maximum Temperature (° C.) |
|---|---|---|---|
| FAST-1 | 91 | 16 | 1275 |
| FAST-2 | 95 | 15 | 1280 |
| FAST-3 | 92 | 15 | 1247 |

Slightly higher temperatures are reached during FAST than observed from HP. However, this does not result in any improvements in the microstructure or density of the formed parts. Only the coarse tungsten carbide powder with a 10 wt % iron-binder additive was used to isolate the effects of FAST on the microstructural morphology and to facilitate comparison of the results to those from the HP process. The hardness shown in Table 3 is the overall average hardness of the material with measurements made in both the core and rim of the material.

Pressureless Sintering

Based on the findings of the HP and FAST studies, an example composition may be the 2-25 wt % iron-alloy binder with the WC having an approximate size ranging from between 0.5-20 microns. In order to understand the effect of the ball mill step, samples of raw powders (i.e. before milling) and milled powders are observed under scanning electron microscopy (SEM). The milling has an effect, as the hard WC particles are "coated" with the softer binder alloy. As a secondary effect, the milling procedure also reduces some of the harsh angular features of the WC particles, which helps the packing efficiency and consolidation of the system during sintering. The ball milling technique is postulated to improve the dispersion of the binder with WC grains prior to and during sintering. The HP technique was investigated using the milled powder, however the reaction with the graphite die/punch surfaces still occur, resulting in the same graded mesostructured and no improvement in the percentage of the theoretical density.

After the CIP process was complete, green densities were measured based on sample geometry and mass. Generally, green body densities for the samples were approximately 60% of the theoretical density. Reaching green density values of this magnitude are essential for producing a dense sample with an extremely high percentage of the theoretical density.

On the whole, percentage of theoretical densities ranged between 55.4% and 96.5% for all PS experiments. A sharp increase in density was noted when increasing the green press load and moving to the secondary CIP procedure providing greatly increased green densities. Density values increased with longer hold times and increased temperatures up to 1450° C. and 10 hours (PS-14: 96.1% TD). Above this level no appreciable increase in density was noted for either higher temperatures or longer hold times. These observations are supported by thermodynamic calculations that indicated that the processing temperature would need to be above ≈1435° C. for complete melting of the binder phase in the case where there was no applied pressure. Therefore, a hold temperature of 1450° C. and hold time of 10 hours were selected as the optimal processing conditions. The cryomilled binder used in PS-10, without a ball milling step, resulted in a density of 89.9% of TD, demonstrating that the cryomilled binder does not produce a substantial improvement in the density under identical sintering conditions. Sintering under vacuum did not produce any improvement in properties.

In contrast to HP and FAST processed material, mechanical properties are uniform across the cross-section, with the observed hardness being above the baseline of the WC-Co materials. Indentation toughness values increase with increasing percent of theoretical density, further indicating that the WC-Fe-alloy material is capable of exhibiting improved properties and performance compared to traditional WC-Co materials at a similar composition. Table 4 provides a comparison of the properties for WC-Co and the optimal WC-Fe-alloy.

TABLE 4

Comparison of the properties for WC-Co and the optimal WC-Fe-alloy

| Material | Binder Amount (wt %) | Hardness, HK2 (GPa) | Palmqvist Toughness, $W_k$ ($MPa(m^{1/2})$) | % TD |
|---|---|---|---|---|
| WC-Co | 11 | 13 | 12 | 97 |
| WC-Fe-alloy | 10 | 16 | 11 | 96 |

Figure 5A:
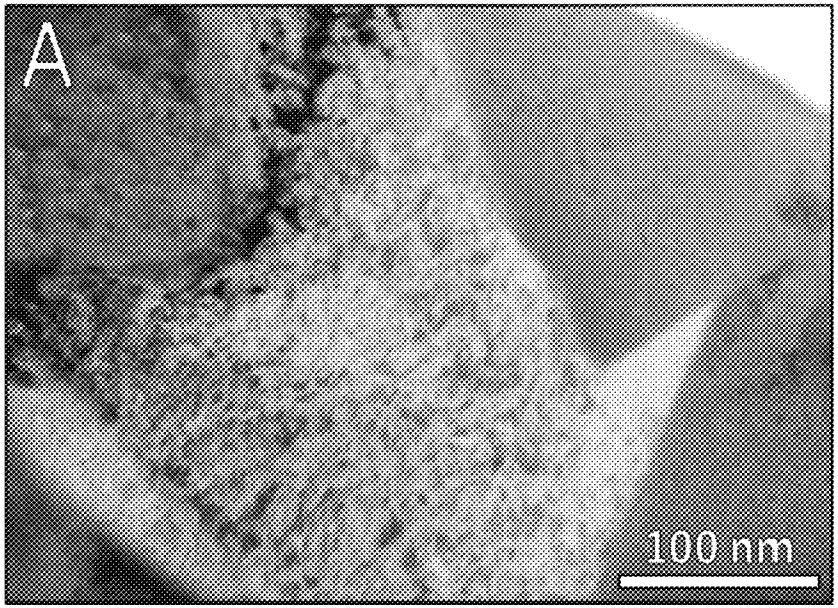
FIG. 5A is a transmission electron microscope (TEM) bright field image of WC with the iron-based binder showing the binder pool between WC grains.
Figure 5B:
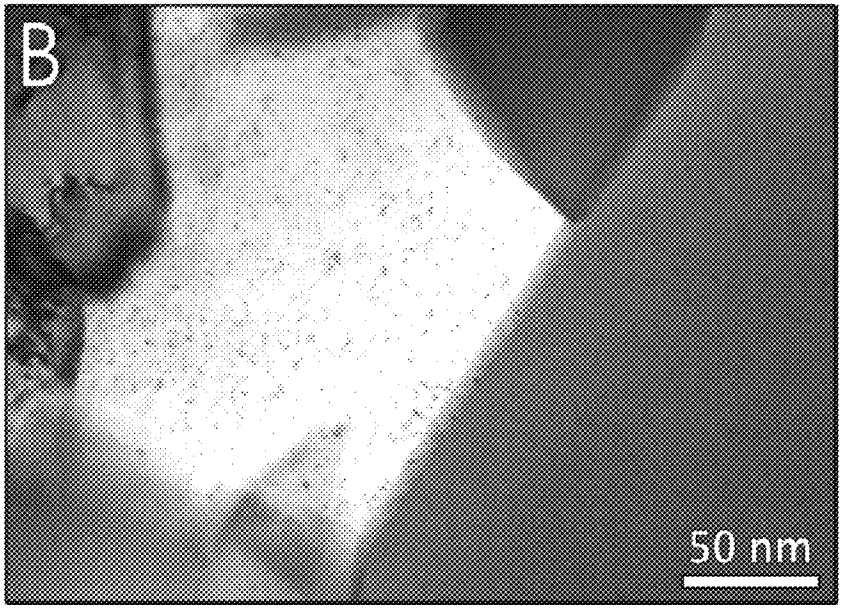
FIG. 5B is a scanning transmission electron microscope (STEM) bright field image highlighting the zirconium-based carbide particles present within a binder pool between WC grains.

FIG. 5A is a TEM bright-field image showing an iron alloy based binder pool between multiple WC grains taken from a PS sample. The binder pool shown is one of the larger ones observed, with dimensions of approximately 200 nm by 200 nm. The pool contains fine particles within it. In order to help resolve the particles, a scanning transmission electron microscopy (STEM) image is shown in FIG. 5B on the same specimen, though from a different binder pool. This enhanced imaging technique allows for the particulates to appear as darker specks within the surrounding binder pool of lighter contrast. This binder pool is slightly larger than the one observed in the original TEM bright field image of FIG. 5A. Nevertheless, within this binder pool, numerous particles with diameters less than 100 nm are present. The size and spacing of such particles provides solid evidence of their ability to pin dislocations, which increases the strength and toughness of the overall material in comparison to a binder pool without such particulates. The fine particles are a zirconium-based carbide, due to zirconium having a stronger affinity to react with carbon than either iron or nickel.

It was demonstrated that sufficiently densified tungsten carbide materials may be produced using the iron-based binder. The 2-25 wt % iron-binder composition was selected to be the composition going forward.

The results of pressureless sintering are deemed to be promising for iron-alloy based binders. Pressureless sintered materials were observed to have a homogeneous microstructure and properties, in contrast to the heterogeneous mesostructures produced via the HP and FAST techniques. Hardness and indentation toughness values are above the baseline values of comparable WC-Co materials.

TEM investigations into the binder regions of the liquid-phase sintered cermets revealed fine carbide particulates contained within the binder pools. These particulates provide a two-fold effect: (1) pinning the tungsten carbide grains from growing, and (2) pinning the dislocation motion within the binder phase. The overall results of the experiment are promising towards the solution of achieving a dense cemented tungsten carbide material with an iron-alloy binder material.

The carbides are introduced by precipitation from the liquid binder chemically reacting with the C in the WC/binder system. The alloying element(s) selected for the Fe-based binder are expected to form a carbide as a thermodynamically stable phase; incorporation of carbide through phase formation rather than as a separate addition may represent a more controllable method for carbide distribution that takes advantage of the economically feasible traditional ball-milling processes.

Figure 6:
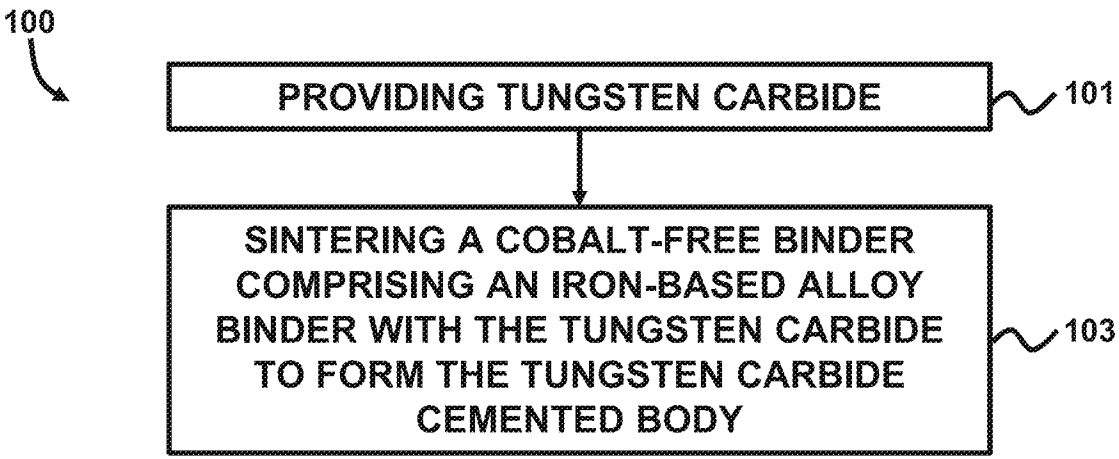
FIG. 6 is a flow diagram illustrating a method according to an embodiment herein.
Figure 7:
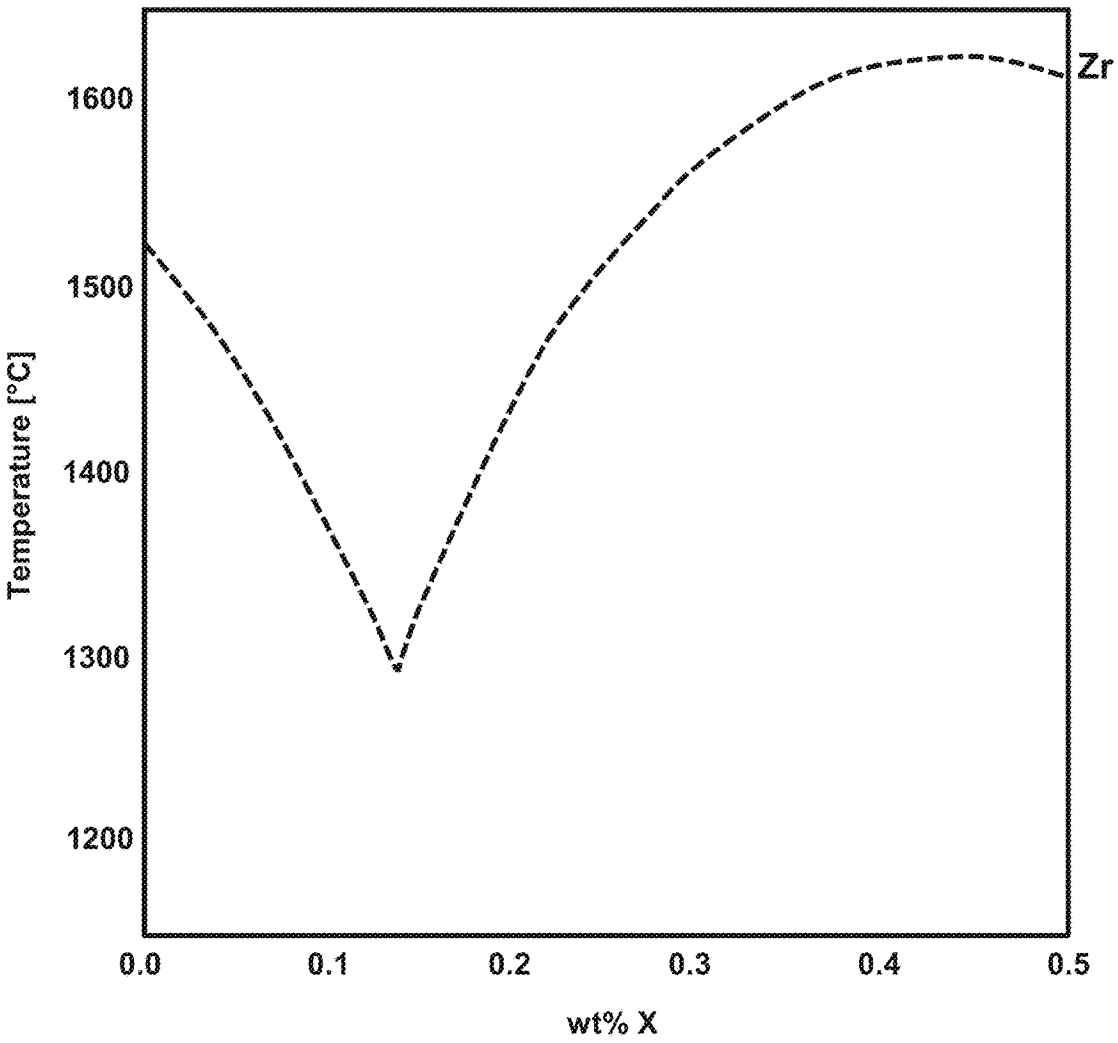
FIG. 7 is a graph illustrating example binder melting temperatures as a function of the percentage of weight of the overall carbide and iron-based alloy.

FIG. 6 is a flow diagram illustrating a method 100 of forming a tungsten carbide cemented body, the method 100 comprising providing (101) tungsten carbide, and sintering (103) a substantially cobalt-free binder comprising an iron-based alloy binder with the tungsten carbide to form the tungsten carbide cemented body, wherein the sintered tungsten carbide and iron-based alloy comprises a hardness value of at least 15 GPa and a fracture toughness of at least 11 MPa√m. In examples, the sintering (103) may comprise a uniaxial hot pressing process, a field assisted sintering technology process, or a pressureless sintering process. Some example iron-based alloy binders, which may be used in accordance with the embodiments herein include: Fe—Ni, Fe—Zr, Fe—Ni—Zr, Fe—V, Fe—Cr, Fe—Ta, Fe—Ti, Fe—Cu, Fe—Mn, Fe—Al, Fe—Nb, Fe—Mn—Zr, Fe—Mn—Ta, Fe—Mn—Ti, Fe—Mn—Al, Fe—Mn—Cr, Fe—Mn—V, Fe—Ni—Ta, Fe—Ni—Ti, Fe—Ni—Mn, Fe—Nb—Cr, Fe—Al—Cr, Fe—Ni—Cr, Fe—V—Cr, Fe—V—Ta, Fe—V—Ti, Fe—V—Al, Fe—V—Ni. FIG. 7 illustrates the example binder melting temperatures as a function of the weight percentage of the overall combined carbide and iron-based alloy. As an example, in the case of a Fe—Ni—Zr binder, increasing the Zr content significantly lowers the melting temperature, enabling less expensive liquid phase sintering processes.

The iron-based alloy may be approximately 2-25% of the overall weight percentage of the cemented tungsten carbide. The cemented tungsten carbide may comprise approximately 90 wt % and the iron-based alloy may comprise approximately 10 wt % of the overall weight percentage of the cemented tungsten carbide. The cemented tungsten carbide phase may have a grain size substantially the same as the original microparticle size before undergoing sintering (103). The tungsten carbide may comprise a substantially same size before and after undergoing sintering. The tungsten carbide may comprise an average microparticle size of approximately 0.5-20 μm. The substantially cobalt-free binder may comprise no more than 0.2 mass % of cobalt. The iron-based alloy binder may comprise zirconium.

The embodiments herein may be utilized in many military and commercial applications, including, but not limited to use as the core material in armor-piercing projectiles used in numerous military weapon systems, cutting tools for the cutting and/or machining of steels, hard metals, metal alloys, and abrasion resistant materials, knives and hammers, road scarfing inserts used for the patching and replacement of asphalt and concrete roadways, bearing and sealing applications, and inserts used in the mining and drilling of rock and earthen material in the coal, oil, and gas industries.

The microstructure of the tungsten carbide with the fine-grained iron alloy confirms the uniform distribution of the iron alloy around the tungsten carbide particles thereby providing a reduced contiguity of the tungsten carbide grains. Furthermore, mechanical properties measured on the tungsten carbide-iron alloy material provided by the embodiments herein meet or exceed those of the conventional cemented tungsten carbide-cobalt material including relative material density, and hardness. Sintering studies conducted through pressureless sintering techniques demonstrated that the processing technique provided by the embodiments herein is capable of producing a homogeneous microstructure with a high percentage of theoretical density along with improved hardness and indentation toughness values.

The embodiments herein eliminate the need of using cobalt in cemented carbide materials, which eliminates a potentially harmful material particularly to human and aquatic life. Indeed, the elimination of cobalt from the tungsten carbide-based cemented carbide material will also significantly reduce overall processing costs since the components of the iron-based alloy system are relatively easier and less expensive to manufacture compared with cobalt-based materials. This also eliminates some safety concerns associated with the fabrication of cemented tungsten carbide components containing cobalt.

The foregoing description of the specific embodiments will so fully reveal the general nature of the embodiments herein that others may, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein may be practiced with modification within the spirit and scope of the appended claims.

What is claimed is:

1. A sintered cemented carbide body comprising:

tungsten carbide; and a substantially cobalt-free binder comprising a dispersion strengthened, iron-based alloy that comprises iron, nickel and zirconium, wherein said cobalt-free binder is sintered with, and uniformly distributed around, the tungsten carbide, wherein the sintered tungsten carbide and iron-based alloy comprises a hardness value of at least 15 GPa and a fracture toughness value of at least 11 MPa√m and further wherein the iron-based alloy comprises a solid solution phase without a graphite.

2. The sintered cemented carbide body of claim 1, wherein the iron-based alloy is approximately 2-25% of the overall weight percentage of the sintered tungsten carbide and iron-based alloy.

3. The sintered cemented carbide body of claim 1, wherein the tungsten carbide comprises approximately 90 wt % and the iron-based alloy comprises approximately 10 wt % of the overall weight percentage of the sintered tungsten carbide and iron-based alloy.

4. The sintered cemented carbide body of claim 1, wherein the tungsten carbide comprises a substantially same size before and after undergoing sintering.

5. The sintered cemented carbide body of claim 1, wherein the substantially cobalt-free binder comprises from about 88 to about 91 atomic percent iron, about 8 atomic percent nickel and from about 1 to about 4 atomic percent zirconium.

6. The sintered cemented carbide body of claim 1, wherein the iron-based alloy binder comprises zirconium.

7. The sintered cemented carbide body of claim 1, wherein the tungsten carbide comprises a microparticle size of approximately 0.5-20 μm.

8. The sintered cemented carbide body of claim 1, wherein the substantially cobalt-free binder comprises no more than 0.2 mass % of cobalt.

9. The sintered cemented carbide body of claim 1, wherein the substantially cobalt-free binder comprises a particle diameter of less than 100 nm.

10. The sintered cemented carbide body of claim 1, wherein the sintered body forms a core in an armor-piercing projectile.

11. The sintered cemented carbide body of claim 1, wherein the substantially cobalt-free binder is cryomilled prior to sintering.

12. The sintered cemented carbide body of claim 1, wherein the substantially cobalt-free binder is formed by cryomilling iron, nickel and zirconium powders.

13. The sintered cemented carbide body of claim 1, wherein the substantially cobalt-free binder is formed by high energy mechanical alloying iron, nickel and zirconium powders.

14. The sintered cemented carbide body of claim 1, wherein the substantially cobalt-free binder is formed by high energy mechanical alloying that includes cryomilling iron, nickel and zirconium powders.

15. A sintered cemented carbide body comprising:

tungsten carbide; and a substantially cobalt-free binder comprising an dispersion strengthened, iron-based alloy that consists essentially of iron, nickel and zirconium, wherein said cobalt-free binder is sintered with, and uniformly distributed around, the tungsten carbide, wherein the sintered tungsten carbide and iron-based alloy comprises a hardness value of at least 15 GPa and a fracture toughness value of at least 11 MPa√m, wherein the iron-based alloy is approximately 2-25% of the overall weight percentage of the sintered tungsten carbide and iron-based alloy, wherein the tungsten carbide comprises approximately 90 wt % and the iron-based alloy comprises approximately 10 wt % of the overall weight percentage of the sintered tungsten carbide and iron-based alloy, wherein the tungsten carbide comprises a substantially same size before and after undergoing sintering, wherein the substantially cobalt-free binder comprises from about 88 to about 91 atomic percent iron, about 8 atomic percent nickel and from about 1 to about 4 atomic percent zirconium, wherein the iron-based alloy comprises a solid solution phase without a graphite, wherein the tungsten carbide comprises a microparticle size of approximately 0.5-20 μm.

wherein the substantially cobalt-free binder comprises no more than 0.2 mass % of cobalt, and further wherein the substantially cobalt-free binder comprises a particle diameter of less than 100 nm.

16. A sintered cemented carbide body comprising:

tungsten carbide; and a substantially cobalt-free binder comprising an dispersion strengthened, iron-based alloy that consists essentially of iron, nickel and zirconium, wherein said cobalt-free binder is sintered with, and uniformly distributed around, the tungsten carbide, wherein the sintered tungsten carbide and iron-based alloy comprises a hardness value of at least 15 GPa and a fracture toughness value of at least 11 MPa√m wherein the iron-based alloy comprises a solid solution phase without a graphite.

17. The sintered cemented carbide body of claim 16, wherein the iron-based alloy comprises a solid solution phase without a or $M_6C$ phase.

* * * * *